United States Patent [19]

Yackiw

[11] 4,307,139

[45] Dec. 22, 1981

[54] PILE WEATHERSTRIP HAVING A LOOPED BARRIER FIN

[75] Inventor: Charles Yackiw, Fairport, N.Y.

[73] Assignee: Schlegel Corporation, Rochester, N.Y.

[21] Appl. No.: 108,399

[22] Filed: Dec. 31, 1979

[51] Int. Cl.[3] ..... D04H 11/00; E06B 7/22

[52] U.S. Cl. ..... 428/85; 49/489; 49/493; 156/72; 428/88; 428/92; 428/95

[58] Field of Search ..... 428/95, 85, 36, 88, 428/92; 156/72; 49/489, 493

[56] References Cited

U.S. PATENT DOCUMENTS 3,175,256 3/1965 Horton ..... 428/85

3,745,053 7/1973 Johnson ..... 428/85

*Primary Examiner*—Marion McCamish

*Attorney, Agent, or Firm*—Cumpston & Shaw

[57] ABSTRACT

The object of this invention is to provide an improved pile weatherstrip having a loop-shaped barrier film. The weatherstrip, which is used for sealing openings between fixed and movable members, comprises a backing strip to which is secured a barrier film of loop-shaped cross section formed, for example, from a polypropylene material. The loop-shaped film is formed from a web of material folded upon itself with one end portion thereof secured in various ways to the backing strip and an opposite looped portion extending from the strip.

12 Claims, 6 Drawing Figures

PILE WEATHERSTRIP HAVING A LOOPED BARRIER FIN

DESCRIPTION

1. Technical Field

This invention relates to an improved pile weatherstrip for forming a draft excluder around doors and windows.

Pile weatherstripping incorporating an impermeable barrier film or fin in sheet form within the pile material has excellent weathering properties, but the presence of the barrier film can cause problems, both with sliding windows, whether of the sash type or of the horizontal sliding type, and with the hinged casement and horizontal pivot windows. For example, the presence of the film increases the breakaway force needed to reverse the direction of the free end of the film and to overcome the friction between window sash and weatherstrip when a window is to be opened. Also, the resistance to a member sliding perpendicular to the barrier film when the motion of the sliding member is reversed is further increased due to the free end of the film catching in minute grooves in the surface of the sliding member. Furthermore, if the window or door is kept closed for a long time, a single barrier film tends to take a set, i.e., it remains in its partially collapsed state, even after the door or window has been opened, thus gradually reducing the weatherstrip's performance. Also, in certain situations, the film tends to collapse or fold over when the weatherstrip is inserted into a groove in a door or window, probably because of reverse bending of the weatherstrip during the insertion process. A further problem with known pile weatherstrip incorporating a barrier fin is that it is rather stiff and resists compression when a door or window is to be shut. This means that to shut the window and compress the strip, considerable force must be applied to the door or window.

I have now developed an improved pile weatherstrip incorporating a looped barrier film which reduces or overcomes at least some of the above problems, the looped film being secured to the backing strip or pile material in various novel ways.

2. Background Art

U.S. Pat. No. 3,745,053 describes a weatherstrip having a backing strip, and two longitudinally extending spaced parallel rows of pile attached to the backing strip. In one embodiment of the invention, single or double barrier fins are interposed in the space between the rows of pile and secured to and supported only by the pile. In FIG. 6, a barrier film of a different configuration is shown positioned in the space between the rows of pile. The barrier film in this embodiment is in the form of a web bent back on itself to form a looped end portion extending away from the backing strip. The opposite end portions of the web are spaced from the backing strip, and the barrier film is secured to and supported only by the pile. Problems that arise in the use of this type of weatherstrip, for example, are leakage of air and moisture through the space between the lower end of the barrier film and backing strip, and increased resilience of the barrier film resulting in excessive leakage of air and moisture past the weatherstrip.

3. Disclosure of the Invention

According to the present invention, I provide pile weatherstripping comprising a backing strip which is preferably flexible, and having pile material projecting from one of its surfaces, and wherein at least one looped barrier film or fin is located adjacent the pile and projects from the backing strip in the same direction as the pile material, said film or fin being in the form of a tube or loop.

Preferably, the tube or loop is provided by an extrusion or a single strip of material folded into a closed or substantially closed configuration, an anchoring end or edge region of the material being secured in various ways to the backing strip.

In one construction, it is envisaged that the single strip of material may be so formed and folded as to provide a double tube or loop.

In one embodiment, the folded end portions or edges themselves are turned up away from the backing strip.

In some instances, the tube or loop may have apertures formed in it throughout its length to allow it to collapse and expand. Normally, however, it would only be open at its ends. The tube or loop in certain instances may also be filled with a collapsible material.

A weatherseal having a looped or tubular type sealing barrier fin has the following advantages over the traditional weatherseals with fin type barriers:

(a) There is no creasing of the barrier when the strip is compressed with resultant loss of sealing characteristics.

(b) When the weatherstrip is compressed in use it offers less resistance than traditional weatherseals, and lower compression set due to the resilience of the looped end forcing the looped end back to its original position.

(c) The looped barrier is always supported by the pile.

(d) The weatherseal does not suffer from shrinkage.

(e) The weather seal presents low break-away forces to sliding members, and less resistance to movement of a sliding member perpendicular to the barrier fin when the sliding member is reversed.

(f) The looped barrier acts as a cushion upon closure of a member against it. In this respect the tubular barrier could, in certain circumstances, be filled with foam or pile.

(g) The flatter and wider sealing surface area of the barrier effects a more positive seal than a single fin-like barrier.

(h) Better sealing in straight compression applications because the looped end deforms along its entire length whereas the free end or ends of single or double sheet fins could change direction along the longitudinal line of contact permitting leakage at the points where the change in direction occurs.

(i) Reduction in noise or squeaking in automotive applications due, for example, to the looped end deforming substantially along a line parallel to a line bisecting the loop, rather than laterally thereof as in a single or double sheet fin.

(j) The dead air space in the tubular barrier acts as an accoustic seal as well as a thermal insulator.

(k) Since the tubular barrier is normally open only at its ends, pressure differentials which are set upon opening or closing of the member against which a seal is to be made can be used as a sensor. It is envisaged, therefore, that the seal could be used as a security system, for example as a burglar alarm, by connecting suitable sensing apparatus to the space within the barrier film.

The invention and its advantages will become more apparent from the detailed description of the invention presented below.

BRIEF DESCRIPTION OF THE DRAWING

Several embodiments of pile weatherstrip containing a looped barrier fin according to the present invention are now described by way of example with reference to the accompanying drawing, in which.

BEST MODES FOR CARRYING OUT THE INVENTION

Figure 1:
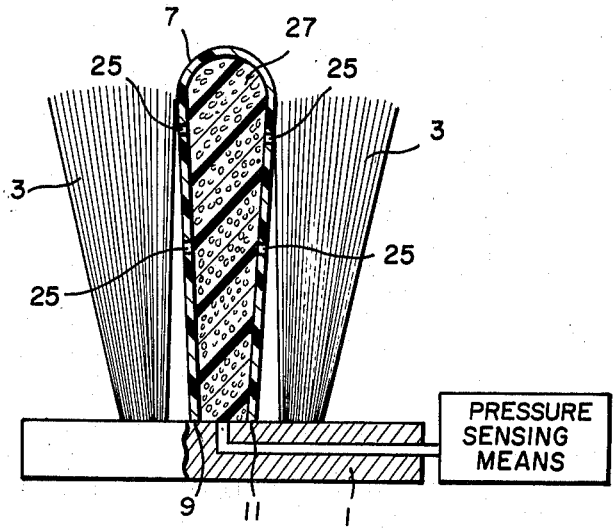
FIG. 1 is a cross-sectional view of one embodiment of the pile weatherstrip of this invention.

In the drawing, similar or like parts have the same reference numerals in the different Figures.

Referring to FIG. 1 of the drawing, the weatherstrip has a conventional flexible backing strip 1 from one face of which the traditional pile material 3 of the required height and density upstands in a pair of spaced rows. Within the space between the rows of pile material, an air impervious looped barrier 7 of generally tubular or substantially closed construction is provided. The barrier 7 is formed from a single strip of polypropylene film or other suitable polymeric material or the like folded through about 180° to form an open end portion comprising two adjacent free ends 9, 11 secured to the backing strip 1 in known manner, e.g., by two separate welds. Barrier 7 also has an opposite closed or looped end portion engageable by a closure member, not shown.

Seen in corss-section, the center barrier 7 presents a looped type configuration. Because only the ends 9, 11 of the film barrier 7 of FIG. 1 abut the base backing strip of the weatherstrip, the attachment of the barrier 7 to the backing strip 1 may not be as strong as desired for some applications.

Figure 2:
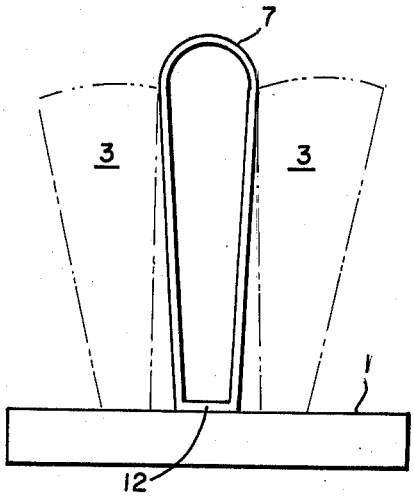
FIGS. 2–6 are end views of other embodiments of the looped pile weatherstrip of this invention.

In the embodiment shown in FIG. 2, the barrier 7 is of tubular form preferably extruded from a suitably shaped die. The barrier 7 has a narrow flat closed end portion 12 that is welded to backing strip 1.

Figure 3:
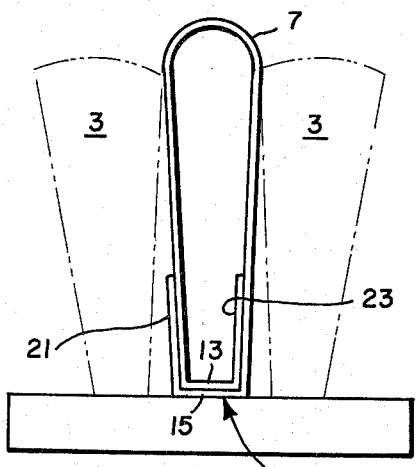

In the construction shown in FIG. 3, the anchoring end portion comprises edge regions 13, 15 of the barrier film 7 which overlap each other as shown at 19 making it possible to weld the barrier 7 to the base of the weatherstrip over a considerable area. The folded end portions 21, 23 of barrier 7 are turned up away from the backing strip 1. With this configuration, it is proposed that the barrier film 7 be folded by any suitable mechanism and enter the welding area on a tapered mandrel cantilevered from the mechanism. The welding would be accomplished at the point of the taper in engagement with the overlapped edge regions. By varying the amount or place at which the edge regions are overlapped, it is possible to position the barrier 7 at the desired height in relation to the supporting pile 3.

Figure 4:
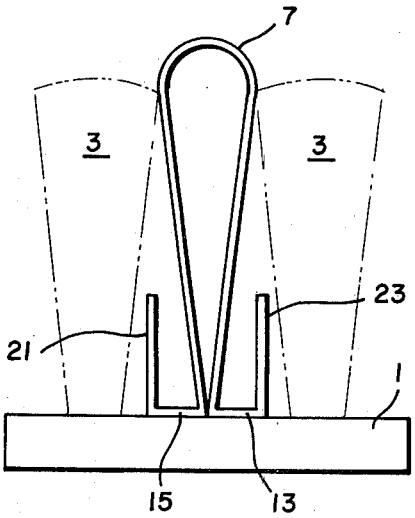

FIG. 4 illustrates a modification of the construction shown in FIG. 3, where the edge regions 13, 15 of the barrier film 7 instead of being overlapped are turned outwardly to lie flat against the backing strip 1 and are secured to the strip 1 by a double weld. It will be appreciated that the height of the barrier 7 can be altered for a given width of film merely by altering the length of the end portions 21, 23 of the film which are turned up away from backing strip 1 without altering the width of edge regions 13, 15.

Figure 5:
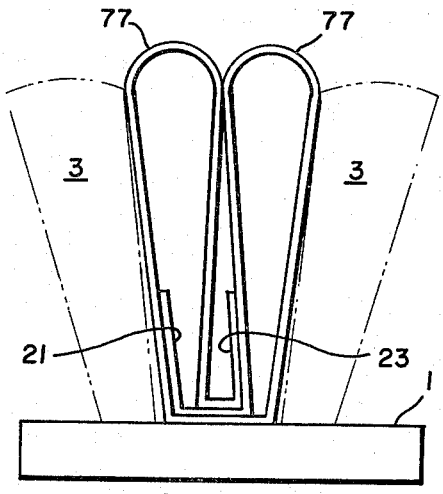

In the construction shown in FIG. 5, a double barrier 77 is provided. Each barrier 77 has a folded end configuration in which the film material is folded on itself with the end portions 21, 23 enclosed so that no sharp edge is presented to the opposite member with which a seal is to be formed. This type of configuration can be controlled for the height above the pile in the same manner as described with reference to FIG. 4. The folded overlapped edge regions of the end configuration can also be readily welded to the base. In this construction and that of FIG. 3, the barrier 7 can be attached to the backing strip 1 by a single weld.

Figure 6:
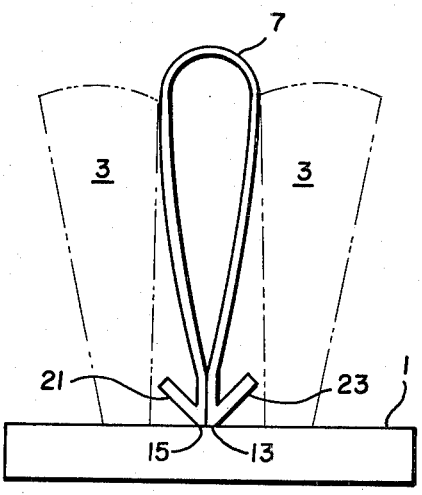

In the embodiment shown in FIG. 6, the end portions 21, 23 of the film are turned up away from the backing strip, and the two edge regions 13, 15 of the film are secured to the backing strip 1 in adjacent relationship, e.g., by two adjacent welds. This allows a more positive connection of the barrier 7 to the backing strip than shown in FIG. 1, for example.

To assist the collapse of the loop(s) and return each loop to its original shape again after the window/door to which it is secured or with which it is to form a seal has been closed/opened, a plurality of apertures 25 as illustrated in FIG. 1 may be provided throughout the length of the tube. This is not normally necessary, however, if the ends of the tubular barrier are left open. Also, the looped barrier 7 could be filled with any suitable collapsible material such as a foam 27, if desired, as seen in FIG. 1.

With this invention, compression forces necessary partially to collapse the weatherstrip when shutting a door or window to which the weatherstrip is fitted are kept low. Also, this type of barrier 7 will offer a minimum of resistance at the sealing point to a member sliding perpendicular to the barrier when the motion of the sliding member is reversed. This configuration of the barrier will also seal better in instances where the sliding member is parallel with the barrier. Furthermore, a tubular type barrier 7 will also seal well in straight compression applications, whereas a barrier with a single or double edge or edges could change direction along the point of contact, permitting leakage at the point of direction change.

Since the looped barrier film 7 is normally open only at its ends, pressure differentials which result within the barrier upon compression of the seal and barrier by opening or closing a member can be used as a sensor. Accordingly, the seal can be used in a security system, for example as a burglar alarm, by connecting suitable pressure sensing means to the space within the looped barrier film as illustrated in FIG. 1.

It is also proposed that a further configuration would have a single or double row of looped pile 3 to act as supporting member(s) for the barrier 7. This would further lessen reversal efforts in applications with the sliding member perpendicular to the barrier 7.

The invention has been described in detail with particular reference to preferred embodiments, but it will be understood that variations and modifications can be effected within the spirit and scope of the invention.

I claim:

1. A barrier fin weatherstrip comprising:

a longitudinally extending backing strip;

a longitudinally extending row of pile having one end surface attached to said backing strip and its opposite free end surface projecting from said backing strip; and a longitudinally extending anchoring barrier fin of loop-shaped cross-section having a longitudinal end portion thereof secured directly to said backing strip adjacent said pile and an opposite longitudinally extending closed looped end portion adjacent said free end surface of said pile.

2. A weatherstrip according to claim 1 wherein said barrier fin is formed from a single web of material folded upon itself to form said loop, and said anchoring end portion is an open end portion.

3. A weatherstrip according to claim 2 wherein said open end portion comprises longitudinally extending free ends of said web which are secured directly to said backing strip.

4. A weatherstrip according to claim 3 wherein said open end portion comprises longitudinally extending edge regions secured to said backing strip.

5. A barrier fin weatherstrip comprising:

a longitudinally extending backing strip;

a longitudinally extending row of pile having one end surface attached to said backing strip and its opposite free end surface projecting from said backing strip; and a longitudinally extending barrier fin of loop-shaped cross-section formed from a single web of material folded upon itself to form said loop, said looped web having a pair of longitudinally extending free web ends folded with edge regions thereof in overlapping relationship and secured to said backing strip, said fin further having a longitudinally extending closed looped end portion opposite said edge regions of said web and adjacent said free end surface of said pile.

6. A weatherstrip according to claim 5 wherein the parts of said web ends extending from said edge regions are further folded to extend upwardly from said backing strip adjacent a surface of said web.

7. A weatherstrip according to claim 5 wherein the parts of said web ends extending from said edge regions are further folded to extend upwardly from said backing strip adjacent a surface of said pile.

8. A weatherstrip according to claim 5 wherein said single web is folded upon itself to form a pair of loops in side-by-side relation.

9. A weatherstrip according to claim 5 or 8 wherein said loop or loops have apertures extending therethrough throughout their length to allow said loop or loops to collapse and expand.

10. A weatherstrip according to claim 5 or 8 wherein said loop or loops are filled with a collapsible material.

11. A weatherstrip according to claim 5 or 8 wherein said loop or loops are connected to a pressure sensor.

12. A barrier fin weatherstrip comprising:

a longitudinally extending backing strip;

a longitudinally extending row of pile having one end surface attached to said backing strip and its opposite free end surface projecting from said backing strip; and a longitudinally extending barrier fin of loop-shaped cross-section having a longitudinally extending anchoring closed end portion thereof secured to said backing strip adjacent said pile and an opposite longitudinally extending looped end portion adjacent said free end surface of said pile.

* * * * *